United States Patent [19]

Lorenz

[11] 4,059,220

[45] Nov. 22, 1977

[54] REINFORCED SINGLE-FACE CORRUGATED CONTAINERS

[75] Inventor: Achim R. Lorenz, Atlanta, Ga.

[73] Assignee: MacMillan Bloedel Containers, Inc., Cleveland, Ohio

[21] Appl. No.: 705,053

[22] Filed: July 14, 1976

[51] Int. Cl.[2] ..... B65D 5/02

[52] U.S. Cl. ..... 229/37 R; 229/DIG. 2; 229/49; 229/90

[58] Field of Search ..... 229/DIG. 2, DIG. 4, 229/37, 32, 90

[56] References Cited

U.S. PATENT DOCUMENTS

| | | | |
|---|---|---|---|
| 472,462 | 4/1892 | Mark | 229/90 X |
| 1,591,061 | 7/1926 | Smith | 229/32 X |
| 1,601,835 | 10/1926 | Smith | 229/DIG. 2 |
| 2,008,608 | 7/1935 | Claff | 229/32 X |
| 2,050,791 | 8/1936 | Graham | 229/49 X |
| 2,710,134 | 6/1955 | Schroeder et al. | 229/DIG. 2 |
| 2,857,091 | 10/1958 | Enzie | 229/37 R |
| 2,933,228 | 4/1960 | Guyer | 229/49 X |
| 3,094,266 | 6/1963 | Hoff | 229/DIG. 2 |
| 3,342,400 | 9/1967 | Kelley | 229/37 R |
| 3,473,723 | 10/1969 | Bolling et al. | 229/37 R |

FOREIGN PATENT DOCUMENTS

| | | | |
|---|---|---|---|
| 277,947 | 11/1964 | Australia | 229/DIG. 4 |

*Primary Examiner*—Davis T. Moorhead
*Attorney, Agent, or Firm*—Bosworth, Sessions & McCoy

[57] ABSTRACT

Reinforced single-face corrugated fiberboard containers of remarkable strength are disclosed which can be mass produced at minimum cost in a high-speed continuous process from a continuous sheet of single-face corrugated material comprising a corrugated web adhesively secured to a single facing sheet having a width much greater than that of the web to provide outwardly extending fly portions of substantial width. The web forms the corrugated core of a single-wall laminated board formed by turning over the fly portions to reinforce the side edges and adhesively securing the fly portions to the corrugations to partially cover the core and to provide the board with double-faced side portions and an unreinforced single-faced middle portion. The laminated board can be passed through rotary cutting dies or the like in a high-speed continuous process to cut and form slotted box blanks having a first set of transverse fold lines dividing the blank into a series of rectangular wall panels, a second set of longitudinal fold lines extending the length of the fly portions, and a series of transverse slots extending from the latter fold lines to the outer side edges of the laminated board to define a series of pairs of double-faced end flaps for closing and reinforcing the opposite ends of the assembled box or carton. The invention also provides strong open-ended containers such as lids, trays and the like which can be produced much more economically than the standard double-faced corrugated products.

4 Claims, 11 Drawing Figures

FIG. 2
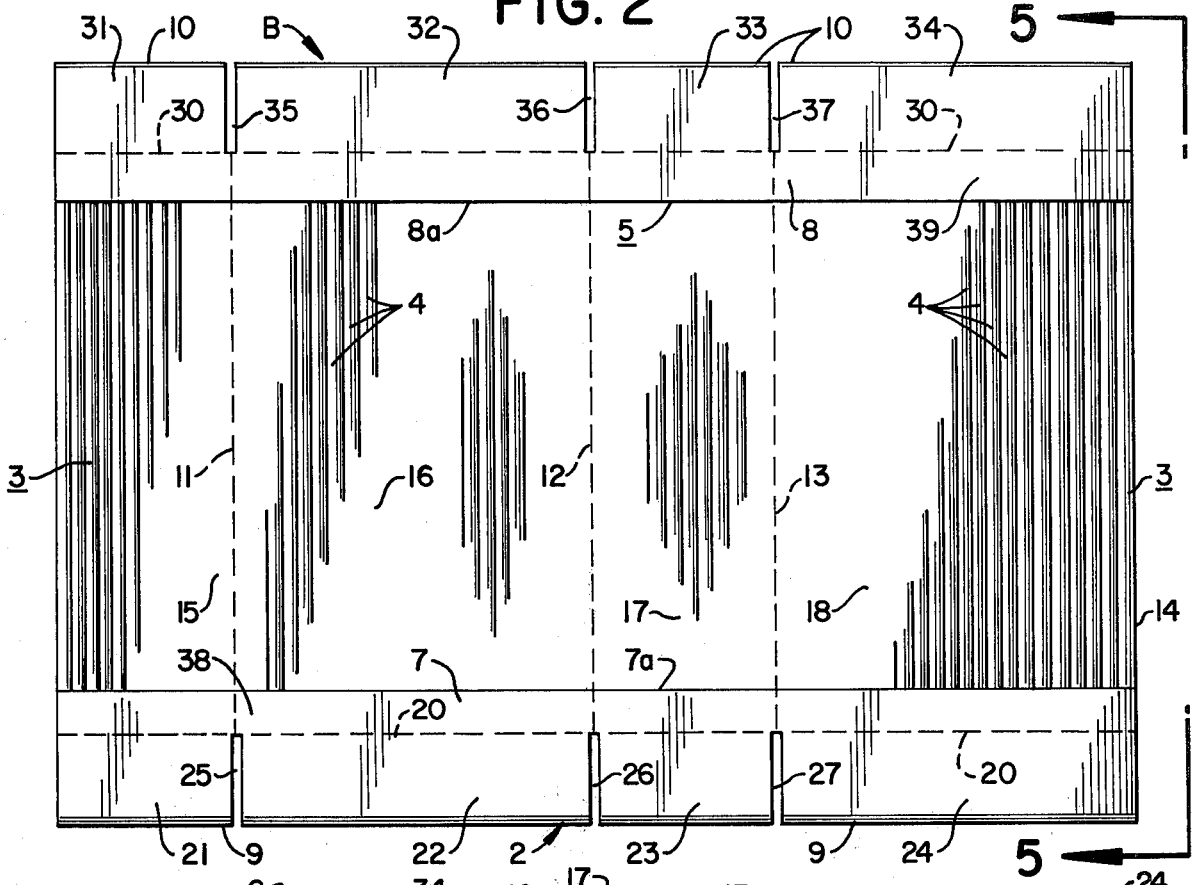
FIG. 3
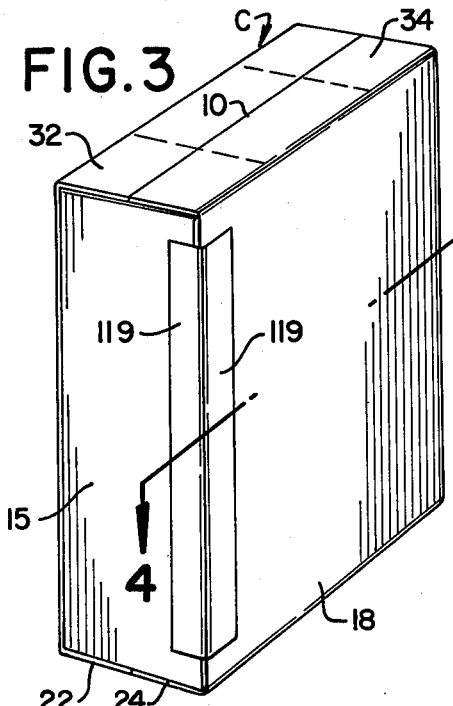
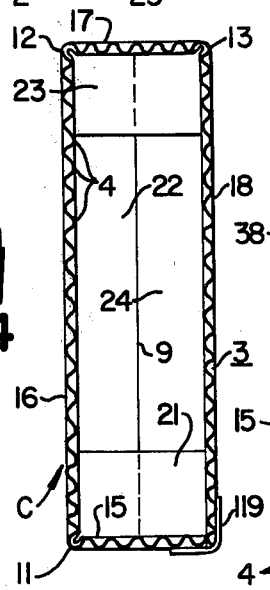
FIG. 4
FIG. 6
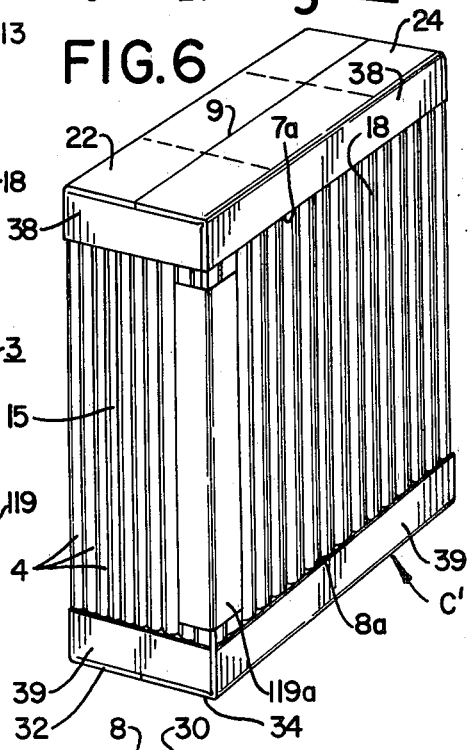
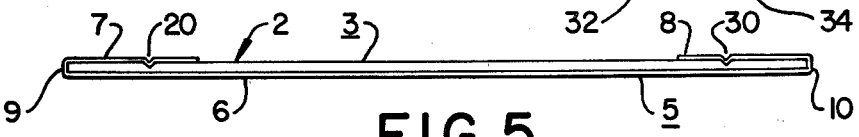
FIG. 5

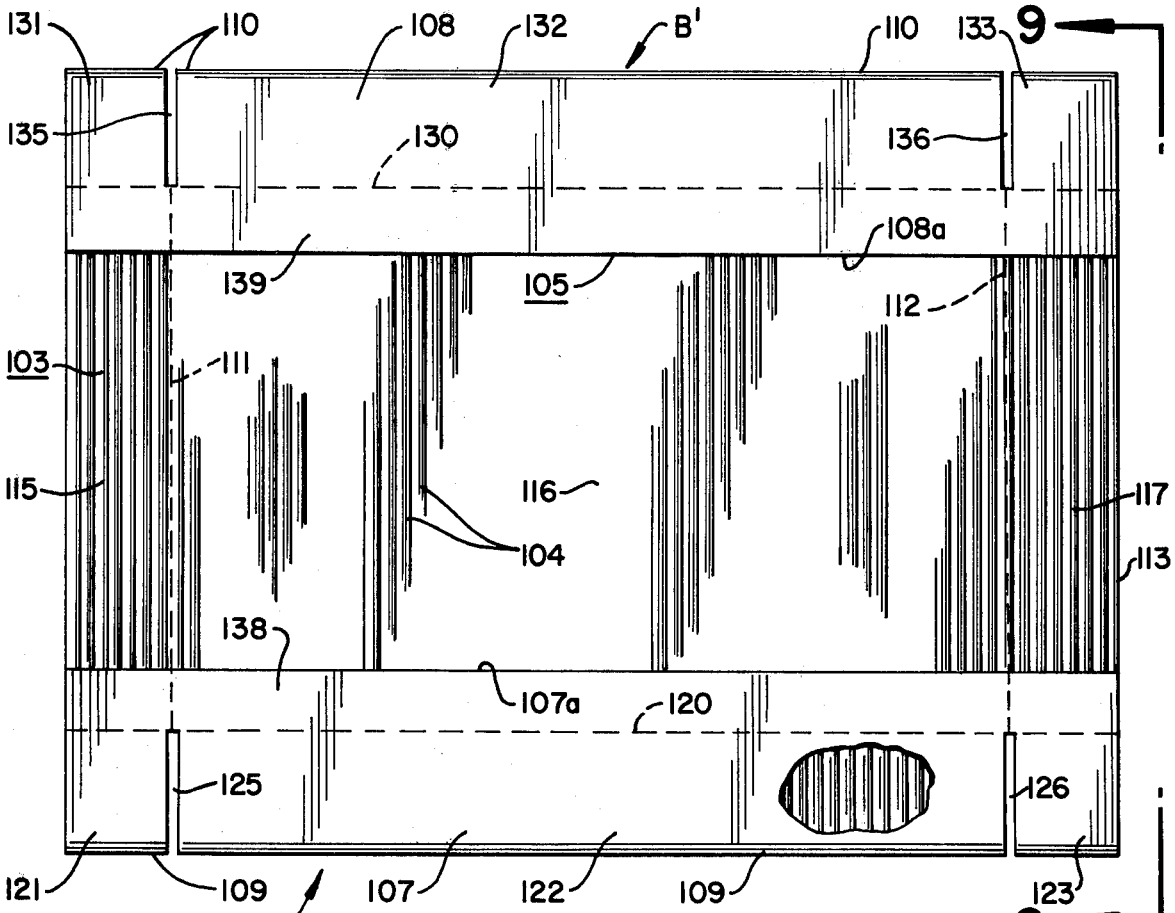
FIG. 7
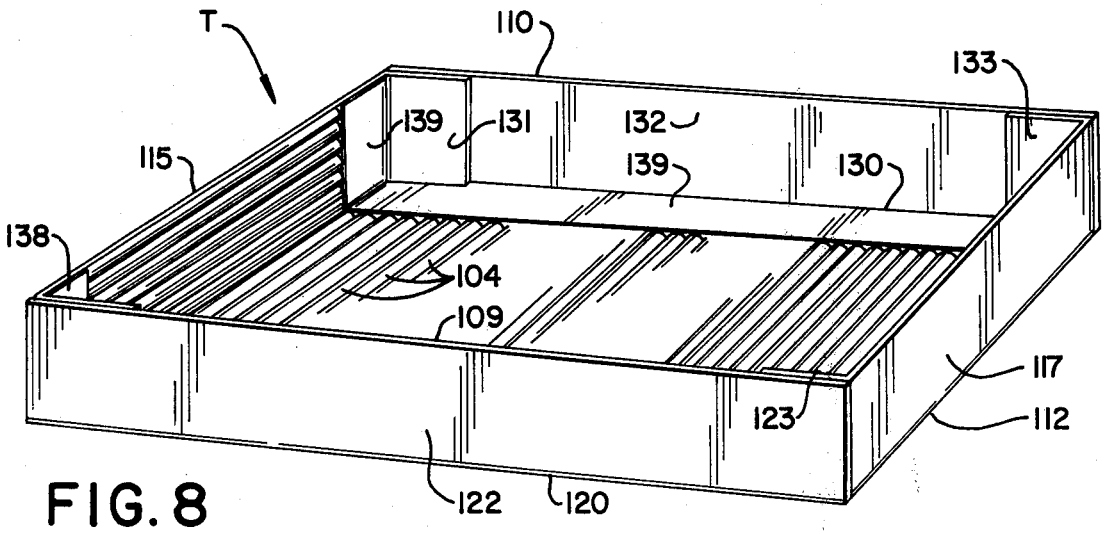
FIG. 8
FIG. 9
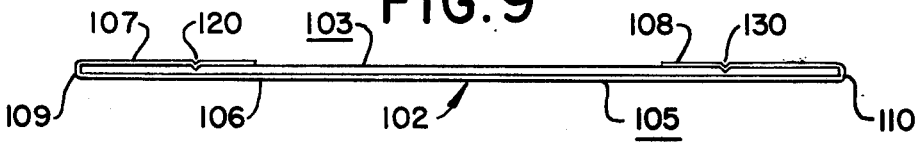

REINFORCED SINGLE-FACE CORRUGATED CONTAINERS

BACKGROUND OF THE INVENTION

Single-face and double-face corrugated paperboard containers have been used extensively for packaging since the turn of the century. In the early days the single-face corrugated paperboard was commonly used as bottle wraps, cushioning, dividers and partitions in wood boxes. Single-face board was often used for wrapping glass bottles and sometimes was provided with a facing sheet wider than the corrugated web to provide fly portions extending beyond the opposite ends of the bottle to provide material for closing the ends of the wrapped package.

During the last 80 years, the use of double-face corrugated board for shipping containers has increased to the point where almost every conceivable item of commerce is shipped in containers made of this material. This corrugated board combines great stiffness and rigidity with high cushioning ability and for this reason has been found ideal for most shipping containers. The flutes of the corrugated core are anchored at both sides to the facing sheets thereby forming a continous arch structure which is similar to the truss structure of a bridge and has tremendous strength. It has been estimated that ninety percent or more of the shipping boxes moving by rail freight are made of double-face corrugated material.

Single-face corrugated board, on the other hand, lacks the strength and rigidity required for shipping boxes and is used principally for wrapping and interior packing. As a result the use of single-face corrugated board has been very limited. It has been estimated that single-face represents only about two percent of all manufactured corrugated board.

For many decades corrugated board has been preferred for a vast majority of shipping containers because of its low cost compared to other materials. The manufacture of single-face and double-face corruguated board is very economical because the board can be made in a continous process using automatic machines capable of operation at very high speeds, sometimes 600 feet per minute or higher. Because of its low cost, it has been difficult to improve upon standard double-faced corrugated board as a material for most shipping containers.

During the last twenty years the manufacturers of the double-face corrugated board have produced improved forms of board wherein the ends of the flutes or corrugations are closed or reinforced by bending or deforming one or both of the facing sheets at the side edges of the board. Various forms of double-faced corrugated board with wrapped or reinforced side edges are disclosed in the following U.S. Pat. Nos. 3,031,256; 3,307,995; 3,399,096; 3,432,375; 3,563,843; 3,579,396; 3,624,236; 3,711,352; and 3,785,908. While these special types of double-faced corrugated boards have certain advantages, their use has been limited because of the added cost of manufacture.

SUMMARY OF THE INVENTION

The present invention makes possible a great reduction in the cost of manufacturing shipping containers and involves the discovery that boxes of remarkable strength and rigidity can be made from inexpensive corrugated board having only one facing sheet.

The blanks used to assemble the containers of this invention can be mass produced at minimum cost in a continuous high-speed process which employs conventional rotary die cutting equipment to cut the blanks and simultaneously form the necessary fold lines or score lines. The process can also utilize other standard equipment, such as automatic taping machines and the like, and is therefore well suited for use by existing box manufacturing plants without large capital outlays. The box The box blanks and containers of the present invention are made from a two-ply laminated fiberboard which may be manufactured in a high-speed continuous process from a sheet of single-face corrugated material consisting of a corrugated web or core adhesively secured to a single facing sheet having a width greater than that of the web to provide outwardly extending fly portions. The fly portions are turned back over the side portions of the core and are adhesively secured thereto to provide the board with double-faced corrugated side portions, the remaining part of the corrugated core between the edges of the fly portions being exposed and free of such reinforcement.

The laminated board is cut and slotted in any suitable manner to provide box blanks or container blanks having a first set of fold lines dividing the blank into three to five wall panels and having a second set of fold lines on the two overturned fly portions, preferably parallel to the reinforced side edges of the blank, to define a plurality of double-faced corrugated panels or flaps along said side edges. The slotted box blanks usually have a series of pairs of slots extending from the fold lines of said second set to the outer edges of the blank to define three to five pairs of double-faced end flaps for closing and reinforcing the opposite ends of the assembled box.

The blanks for making lids or tray-like containers each have a main rectangular central panel bounded by the fold lines of said first and second sets and four outer wall panels hingedly connected to the central panel at said fold lines for forming the peripheral walls of the assembled container. Double-faced corner flaps are preferably provided at the four corners of the blank by cutting longitudinal or transverse slots at opposite ends of the double-faced portion of the blank. Each corner flap is hingedly connected to the end of an outer wall panel and can be positioned for attachment to the adjacent outer wall panel in the assembled container.

The strength of boxes or other containers made according to this invention is somewhat less to that of conventional containers made of double-face corrugated board because major portions of various wall panels are of single-faced construction, but the containers of this invention have remarkable strength and are important for many commercial packaging applications because of the savings in raw materials and because of the reduced cost of manufacture relative to conventional double-faced corrugated containers. The shipping containers of this invention can be manufactured at minimum cost using a high-speed continuous process and relatively simple equipment.

BRIEF DESCRIPTION OF THE DRAWINGS

In the drawings:

FIG. 2 is a top view on a reduced scale showing a slotted box blank made according to one embodiment of this invention;

FIG. 3 is a perspective view on a reduced scale showing an assembled carton made from the blank of FIG. 2;

FIG. 4 is a horizontal sectional view taken on the line 4—4 of FIG. 3;

FIG. 5 is an end view of the box blank looking in the direction of the arrows 5—5 of FIG. 2 and on the same scale;

FIG. 6 is a perspective view of an alternative form of a carton made from the box blank of FIG. 2;

FIG. 7 is a top view of a slotted tray blank made according to another embodiment of this invention;

FIG. 8 is a perspective view of an assembled tray made from the blank of FIG. 7;

FIG. 9 is an end view of the tray blank looking in the direction of the arrows 9—9 of FIG. 7.

DESCRIPTION OF THE PREFERRED EMBODIMENTS

Figures 1, 4A, 10:
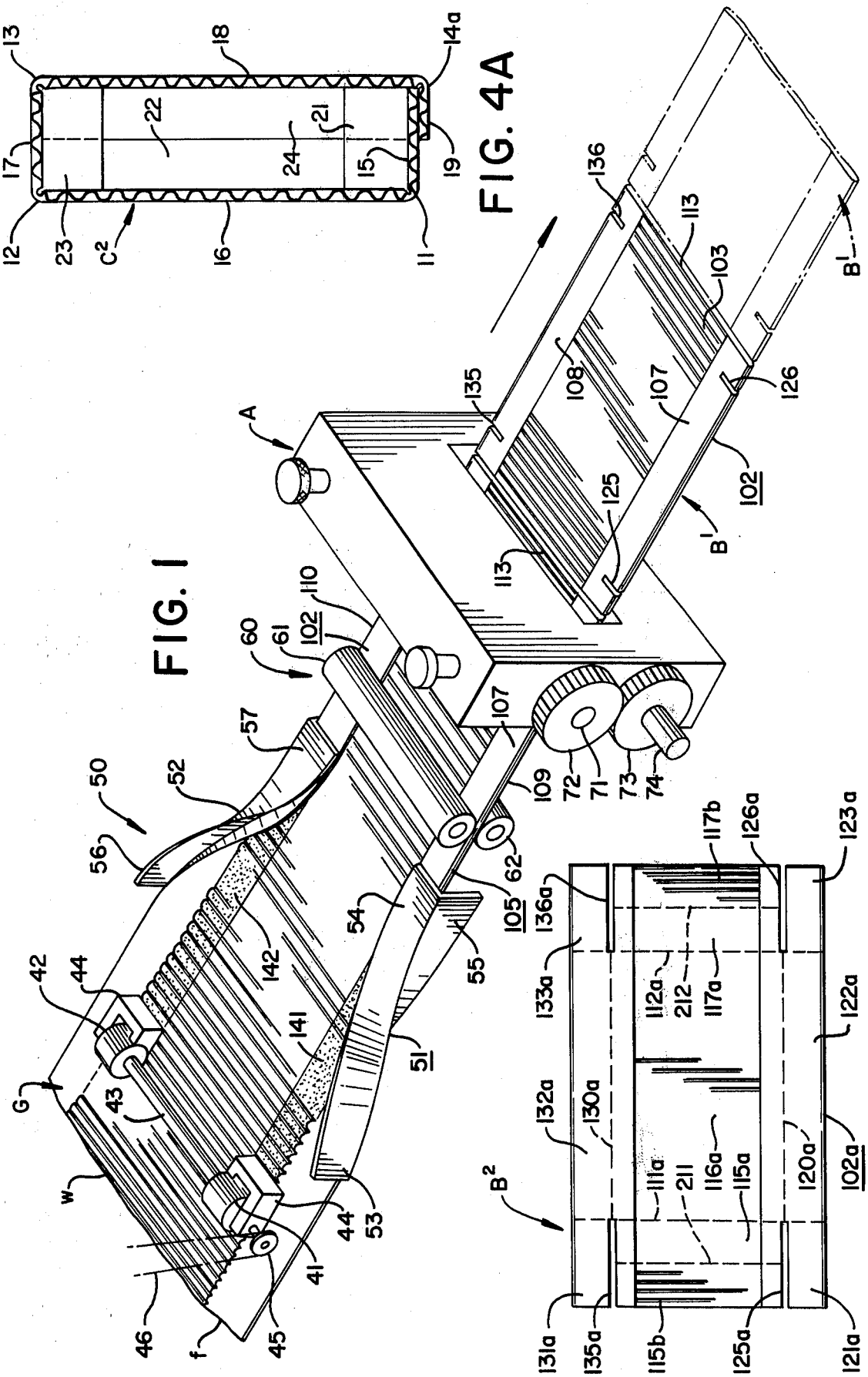
FIG. 1 is a schematic view on a reduced scale showing apparatus for forming corrugated fiberboard container blanks according to the invention.
FIG. 10 is a top view on a reduced scale showing a special alternate form of tray blank made according to the invention.

Referring more particularly to the drawings, in which like parts are identified by the same numerals throughout the several views, FIG. 1 illustrates schematically an apparatus for continuous high-speed mass production of corrugated fiber-board container blanks according to this invention. This apparatus is constructed to form, crease and cut the container blanks in a continuous process employing a continuous corrugated web *w* of uniform width and a flat continuous facing sheet *f* having a width substantially greater than that of the web. The apparatus includes a glue station G with conventional glue rollers for applying adhesive to the outer portions of the flutes of the corrugated web, a turnover guide assembly 50 for folding the fly portions of the facing sheet back over the side portions of the web, a pressure roll unit 60 for applying pressure to the facing sheet and the web to adhere the overturned fly portions of the facing sheet to the adhesive bearing portions of the web, and a rotary die cutting unit A for cutting the laminated board to length while cutting the necessary slots and forming the desired score lines of fold lines. The apparatus of FIG. 1 will be described in more detail hereinafter, it being understood that various methods may be employed for manufacturing the box blanks or container blanks of this invention.

As shown in FIG. 1 the box blanks are formed from a continuous two-ply single-faced laminate having an extra wide facing sheet f adhered to the corrugated web w. This two-ply laminate can be made on high-speed machines which function generally the same as conventional single-facer machines and which are able to accommodate the extra-wide facing sheet.

The first operation in the manufacture of conventional double-face corrugated paperboard is the making of single-face paper comprising a single full-width web of flat paper bonded to a corrugated or fluted web to form a two-ply flexible laminate. Such single face paper is made in a single-facer machine which draws and unwinds the web from each of two paper rolls. This corrugating and laminating operation can be performed continuously in modern machines at speeds of 400 to 650 feet per minute or higher.

As one paper sheet is corrugated on the corrugating roll, a suitable adhesive, such as a silicate or starch paste, can be applied to the outer portions only of the flutes by a glue applicator roll as indicated, for example, in U.S. Pat. Nos. 3,290,205 and 3,671,361. Thus a line of adhesive can be applied to the outer portion of each corrugation along its full length before it contacts the facing sheet.

The two-ply single-face corrugated laminate produced as indicated above can be employed for manufacture of conventional double-face corrugated board in a double-facer machine where it is combined with a second facing sheet, again at high speeds, such as 400 to 650 feet per minute or higher.

The first step in this operation is to apply adhesive to the tips of the flutes or corrugations of the laminate. The adhesive is perferably applied by glue rollers as shown, for example, in U.S. Pat. Nos. 3,303,814; 3,307,995; 3,579,396 and 3,775,211. The glue rollers can extend substantially the full width of the corrugated web so that each corrugation is adhered to the second facing sheet substantially throughout its length to provide a double-face corrugated board of high strength.

Similar glue rollers may be employed in the practice of the present invention, but they should have a short length so as to apply glue along narrow areas at the side portions only of the corrugated web (see FIG. 1).

It is thus seen that the manufacture of container blanks according to this invention involves corrugating and glueing operations quite similar to those employed in the manufacture of conventional double-face corrugated container blanks and that similar equipment may be employed for these operations.

Except for the extra material in the fly portions 107 and 108 of the sheet f, the two-ply laminate fed to the glue station G of FIG. 1 is essentially the same as the single-face corrugated laminate used to make conventional double-face board. Thus the middle portion (6, 106) of the extra-wide facing sheet f which covers the web w can be adhered to all of the corrugations of said web, preferably along the major portion of the length of each corrugation. The glue rollers can extend the full width of the web w to apply a line of adhesive to the tip of each corrugation extending substantially the full length of the corrugation before it was adhered to the sheet *f*.

Two-ply laminates similar to the laminate formed from sheet *f* and web *w* are unusual but are known for use as flexible wrappers for wrapping bottles, bulbs, and other articles. Such flexible wrappers have been known for many decades and are disclosed, for example, in French Pat. No. 1,044,964 and U.S. Pat. No. 2,553,923, but the use of special flexible wrappers of this type has been very limited.

In the practice of this invention, the web w used to form the core of the container blank may be provided with corrugations of the same size and shape as used in the corrugated cores of conventional double-face board. There are four different board heights of double-face board in common use. The highest is called A flute, followed by C, B and E flute, in decreasing order. The most popular is C flute. These and other flute sizes may be employed in the container blanks of this invention.

While various forms of containers may be made in accordance with the present invention, the invention is particularly advantageous in connection with slotted container blanks for making boxes, trays, lids and the like. FIGS. 2 and 5 illustrate one form of slotted box blank B which may be made according to this invention. FIG. 7 and 9 show another form of blank of the type used for making trays, lids, covers or other shallow open-top containers. FIGS. 2 to 9 are drawn substantially to scale to facilitate an understanding of the invention.

The blank B shown in FIG. 2 comprises a two-piece laminated board 2 of general rectangular shape having a rectangular corrugated core 3 with a multiplicity of regularly arranged parallel flutes or corrugations 4 extending transversely between the opposite sides of the core, preferably perpendicular to the side edges of the core, and having a single facing sheet 5 with a width substantially greater than that of said core. The facing sheet has a main rectangular central portion 6 that is secured to and covers one face of the core and has a pair of overturned fly portions 7 and 8 that are secured to and cover the outer side portions only of the opposite face of the core. The fly portions are preferably rectangular and of the same width and have a width less than the distance between their edges 7*a* and 8*a*. Each of the fly portions preferably has a length several times its width and extends along the opposite sides of the core to provide straight reinforced side edges 9 and 10 extending throughout the length of the board 2. The sheet 5 is preferably turned back in such manner as to engage the ends of the corrugations 4 as indicated in FIG. 5 and to provide a strong reinforcement at the edges 9 and 10.

The exposed middle portion of the corrugated core 3 between the fly edges 7*a* and 8*a* has a substantial width, preferably several times that of each fly portion 7 and 8. While a somewhat stronger container can be produced by employing wider fly portions, it is undesirable to provide the fly with a width substantially greater than one-fourth the width of the container blank. It is usually preferable to provide fly portions with a width from about 10 to about 20 percent of the width of the blank to save material and to facilitate high-speed production at minimum cost. In a typical box blank, each fly portion has a width at least 0.5 inch and preferably 1 to 2 inches greater than the width of its associated end flaps and a major portion of the corrugated core of each side wall panel is exposed between the edges 7*a* and 8*a*. A box made according to this invention has adequate strength even though a major portion of each of the wall panels (15 to 18) is of single-face corrugated construction.

In accordance with the present invention the container blank, such as blank B, B′ or $B^2$, has a first set of fold lines transverse to the fly portions of the facing sheet which divide the blank into three to five wall panels and has a second set of fold lines located on the fly portions which extend lengthwise of the fly portions, preferably from one end of the blank to the other, to provide hinged connections for a plurality of double-faced corrugated panels. In the case of a box blank, the latter panels may comprise a series of end flaps hingedly connected to the wall panels and adapted to close both ends of the assembled box or carton. For example, the box blank can have three to five wall panels and three to five pairs of double-faced ends flaps, each pair being located at opposite ends of a wall panel and being separated from an adjacent pair of flaps by narrow slots extending outwardly from the hinged side of the associated wall panel in a direction parallel to the corrugations. A blank with only three wall panels can be employed to make tubular boxes of triangular cross section, but rectangular boxes are usually preferred.

As herein shown the blank B of FIG. 2 is rectangular and has a first set of fold lines 11, 12 and 13 perpendicular to the fly portions 7 and 8 parallel to the corrugations 4 which divide the blank into a series of rectangular wall panels 15, 16, 17 and 18, each of which is hingedly connected to an adjacent wall panel along a fold line of said first set. As shown, the outer edge of the wall panel 18 is cut or slit at line 14 parallel to the fold lines 11, 12 and 13, and a strip of tape 119 or other suitable means is provided for joining the panel 18 to the side wall panel 15. If desired, the cut line 14 may be a fold line, and a narrow attaching panel 19 may be hingedly connected to the panel 18 as indicated in FIG. 4A. Thus the invention applies to five-panel box blanks or five-panel folders as well as four-panel box blanks.

A blank B shown herein has a second set of parallel fold lines 20 and 30 located on the fly portions 7 and 8 which extend the full length of the fly portions to define eight rectangular double-faced corrugated panels or end flaps 21, 22, 23, 24, 31, 32, 33 and 34. Each of these flaps is hingedly connected to one of the wall panels 15 to 18 along the fold line 20 or 30. A series of narrow slots 25, 26 and 27 are provided in one double-faced corrugated portion of the board 2 which extend outwardly from the fold line 20 perpendicular to the side edge 9 to separate the associated end flaps at one side of the blank, and a series of slots 35, 36 and 37 are provided in the other double-faced corrugated portion of the board 2 and extend outwardly from the fold line 30 perpendicular to the side edge 10 to separate the end flaps at the other side of the blank. This leaves the narrow double-faced corrugated portions 38 and 39, which are located inwardly of the aforesaid fold lines 20 and 30, respectively, and extend the full length of the blank along the inner edges 7*a* and 8*a* of the sheet 5. Thus the narrow portions 38 and 39 reinforce the opposite ends of each of the wall panels 15 to 18, the middle portion of the corrugated core 3 between the edges 7*a* and 8*a* lacking such reinforcement and consisting essentially of single-faced board.

All of the end flaps of the box blank B consist of double-faced corrugated board, and they are preferably reinforced at the side edges 9 and 10, but it will be understood that in some special situations, it may be desirable to cut some of the end flaps so that they have a different width than other end flaps. As herein shown all of the eight end flaps of the blank B have the same width, which is about half the width of each of the panels 15 and 17, so that the outer pairs of flaps meet when the box is closed as shown in FIG. 3. It will be understood however, that the present invention contemplates wider boxes which may require a closure member, such as a separate layer of fiberboard in addition to the end flaps to close the end of the box if the flaps are too narrow to effect a complete closure. It is usually preferable to provide end flaps with a width at least half that of the side wall panel (e.g., panel 15 or 17) so that they can completely close the ends of the assembled box without auxiliary closure means.

The box blank B can be folded at the fold lines 11 and 13 by swinging each of the panels 15 and 18 against panel 16 to place the cut edge 14 adjacent the outer edge 214 of the wall panel 3, and the adjoining edges of the panels 15 and 18 may be connected by adhering thereto a flat strip of reinforced tape 119 (FIG. 3) to form a hinged connection between the panels. As herein shown the panels 16 and 18 are of the same width and provide the front and back walls of the rectangular box, and the panels 15 and 17 are of the same but smaller width to provide the side walls of the box. With this construction, the folded box blank with the panels 15 and 18 joined together by the tape 119 or an attaching flange 19 (FIG. 4a) can provide a flat collapsed tube (not shown) convenient for storing prior to assembly of the carton. The blank B is well suited for use with an automatic taping machine for applying the tape 119, and therefore the taped collapsed tube can be manufactured in a high-speed continuous process at minimum cost.

When it is desired to assemble the carton, the flat collapsed tube, with the main panels 16 and 18 in engagement, may be opened up by separating the main panels and bending the side panels 3 and 17 to positions perpendicular to said main panels. Then the inner flaps 21, 23, 31 and 33 can be bent inwardly and the outer flaps 22, 24, 32 and 34 can be bent inwardly at right angles to the wall panels to complete the carton as shown in FIGS. 3 and 4. In these figures the large central portion 6 of the facing sheet is located at the outside of the core 3 at every face of the carton so that the corrugations are not visible.

FIG. 6 illustrates a modified form of carton C′ in which the box blank B is assembled in a reverse manner and a reinforced strip of tape 119a is applied to the corrugations 4 instead of to the facing sheet 5. This carton has the double-faced portions 38 visible at the opposite ends of the carton and the corrugations 4 exposed around the outside periphery. The advantage of the carton C′ is that the exposed corrugations provide resistance to sliding when the box is placed against a wall or against another box. In the case of small cartons, the exposed corrugations also can make it easier for a person to grip the box when carrying it.

The box of FIG. 6 is particularly advantageous when each of the double-faced portions 38 and 39 has a width no greater than one-fifth the height of the wall panels measured in the direction of the corrugations. The preferred width depends on a number of variables, such as the type of article being shipped, the amount of strength required, and the size of the box.

The size of the box blanks may vary considerably but a typical box blank similar to the blank B, may have a width from 10 to 20 inches measured in the direction of the corrugations and may have end flaps with a width from 1 to 3 inches and fly portions with a width 1 to 2 inches greater than that of the end flaps. In most boxes, the side wall panels would have a width about twice that of the end flaps so that the ends of the outer pair of flaps meet when the box is closed.

FIG. 4*a* shows a modified form of carton $C^2$ made from a slotted box blank which is the same as the box blank B of FIGS. 2 and 5 except that the cut line 14 is replaced by a score line or fold line 14*a* and that a narrow generally rectangular attaching panel 19 extends between the fold lines 20 and 30 and is hingedly connected to the wall panel 18 along the fold line 14a.

The glue panel 19 may be of a conventional type as shown in U.S. Pat. No. 3,361,326 or in my U.S. Pat. No. 3,924,799 and may be glued to the first wall panel 15 after the panels 15 and 18 of the flat box blank have been bent 180° to form a flattened tube similar to that shown in FIG. 6 of my patent.

As shown herein, the fifth wall panel 19 of the carton $C^2$ overlaps the first wall panel 15 at the corner of the box and serves as a glue panel or attaching panel. It will be understood, however, that the overlap can be reduced or eliminated by reducing the width of panel 15 relative to panel 17. For example, each of panels 15 and 19 can have a width about half that of panel 17 so that their parallel outer edges meet at the middle of the side wall of the assembled carton. These panels can readily be taped together along the line where the edges meet using an automatic taping machine to provide a flattened tube convenient for stacking or storage.

In the carton $C^2$ the first and fith wall panels meet and overlap at the narrow side wall of the carton. This invention also contemplates five-panel cartons or folders wherein the first and fifth wall panels meet or overlap at the wide front or rear wall or the carton. This type of arrangement for five wall panels is illustrated, for example, in U.S. Pat. Nos. 2,833,404 and 3,432,375. The invention also contemplates six-panel box blanks with five transverse fold lines and two glue panels of the type disclosed in U.S. Pat. No. 3,361,326.

At the present time corrugated board is used most extensively in the manufacture of conventional slotted style boxes. The slotted style of box is most important because it is adapted to high-speed rotary methods of production with a minimum waste of raw materials. Such boxes are usually made from one piece of fiberboard with is scored and slotted to form a body for flaps for closing each of the two opposite ends of the box. The lengthwise flaps either meet or overlap depending on the particular style of box.

The present invention is well suited for the manufacture of slotted style boxes including those commonly designated as regular slotted containers (RSC), overlap slotted containers (OSC), full overlap slotted containers (FOL), and center special overlap slotted containers (CSC). These are described in detail in "Corrugated Box Manufacturers Handbook", Third Edition, published 1965.

All the flaps of a regular slotted container are of the same length, and the outer flaps meet at the center of the box. These boxes are used more than any other style.

The overlap slotted container has all flaps of the same length but the outer flaps overlap a substantial distance from 1 inch or more up to the full width of the box, and the inner flaps usually do not meet. The overlapping flaps can be connected by staples to close to the end of the box.

Where the outer flaps completely overlap, this is known as the full overlap container (FOL). The center special overlap slotted container (CSC) is almost the same as the overlap slotted container (OSC), but the inner flaps meet at the center of the box. In such a container the inner flaps are usually longer than the outer flaps so that use of such container in the practice of this invention would involve cutting some of the flaps along the outer edge to expose the open ends of the corrugations of the core. Such open ends may be exposed at the outer edges of all of the end flaps, but it is important to have the facing portions 7 and 8 integral with the main facing sheet 6 to provide each flap with a closed reinforced outer edge.

The present invention is also well suited for the manufacture of five-panel folders (FPF). A conventional five-panel folder provides a box which can be formed from a single cut and scored piece so as to provide an unbroken single wall thickness of fiberboard of three of the six surfaces and usually a double wall thickness on the remaining three surfaces of the box.

Slotted style boxes made according to the present invention may be closed like conventional boxes by employing glueing, staples, stitching and the like. Four approved methods are commonly used to close the containers. The first involves applying glue to the major portion of the area of contact. The second involves securely fastening all of the flaps with metal rivets, staples or stitches. The third method involves securely sealing all outer seams along the full length with paper sealing strips having a width of at least 2 inches. The fourth method involves securely sealing the center seams only with reinforced tape at least 3 inches wide running the full length of the seam and extending several inches over the ends.

The present invention is particularly advantageous for the manufacture of trays or shallow open-top containers when using blanks with a large central wall panel for forming the main wall or bottom wall of the lid or container. As shown in FIG. 7, the blank B′ comprises a two-piece laminated board 102 having a generally rectangular corrugated core 103 with transverse flutes or corrugations 104 extending between the opposite sides of the core and having a single-facing sheet 105 with a width substantially greater than that of the core. The facing sheet has a main rectangular central portion 106 (FIG. 9) that is secured to and covers one face of the core and has a pair of overturned fly portions 107 and 108 that are secured to and cover the outer side portions only of the opposite face of the core. The fly portions 107 and 108 are preferably rectangular and of the same width, and each of them preferably has a length several times its width. Each fly portion extends the full length of the core to provide reinforced side edges 109 and 110. The blank B′ has a first set of fold lines 111 and 112 perpendicular to the fly portions 107 and 108 and preferably parallel to corrugations 104 which divide the blank into a series of wall panels 115, 116 and 117. The latter panel is cut along a straight edge 113 parallel to the fold lines 111 and 112 so that the panel 117 is rectangular and of the same size as the panel 115. The blank B′ has a second set of fold lines 120 and 130 located on the fly portions 107 and 108 which extend the full length of the blank parallel to the reinforced edges 109 and 110 to define a plurality of double-faced corrugated panels or flaps 121, 122, 123, 131, 132 and 133.

The panels 121, 123, 131 and 133 are auxiliary corner flaps for reinforcing the four corners of the assembled tray or container, and it will be understood that these flaps may be omitted where the corners of the containers are taped or may be separated from the panels 115 and 117 and hingedly connected to the panels 122 and 132 by providing longitudinal slots adjacent the corner flaps (see FIG. 10). In other words, the slots 125, 126, 135 and 136 may extend parallel to the side edges 109 and 110 as in the blank $B^2$ instead of perpendicular thereto as in the blank B.

It will be apparent that the basic elements of the box blank B′ are the main central panel 116 and the four marginal wall panels 115, 117, 122 and 132 which are hingedly connected to the main panel along fold lines 111, 112, 120 and 130, respectively.

As shown in FIG. 7 the narrow slots 125 and 126 are perpendicular to the fold line 120 and extend outwardly therefrom in alignment with the fold lines 111 and 112. The slots 135 and 136 extend outwardly from the fold line 130 in a similar manner to separate the auxiliary corner flaps 131 and 133 from the main side panel 132. The narrow double faced corrugated portions 138 and 139 inwardly of the fold lines 120 and 130 extend the full length of the blank along the inner edges 107*a* and 108*a* of the facing sheet. Thus the portions 138 and 139 reinforce the opposite ends of each of the panels of 115, 116 and 117.

The blank B′ can be assembled by bending the marginal panels perpendicular to the bottom wall panel 116 and bending the corner flaps perpendicular to the associated panels so that they can be positioned against or attached to adjacent marginal panels of the tray T as shown in FIG. 8. The auxiliary corner flaps can for example be glued to or stapled to the end portions of the panels 122 and 132 to provide a rigid construction. In the tray T of FIG. 8 the end walls 115 and 117 have a strong double-faced construction at 138 and 139 and and weaker single-faced construction at the middle of the wall. If it is desired to provide the end walls with additional reinforcement, the corner flaps can be lengthened and arranged to fit against the end walls so as to cover at least a major portion thereof. This type of construction is illustrated in FIG. 10, and it will be understood that many other modified constructions can also be employed.

FIG. 10 shows a modified form of tray blank $B^2$ which is similar to the tray B′ but is so constructed that the end walls of the tray are strongly reinforced. The blank $B^2$ comprises a laminated board 102*a* having a rectangular corrugated core with transverse corrugations and a single-facing sheet. Thus the laminated board 102*a* is generally the same as board 102 except for the location of the fold lines and slots. The blank $B^2$ has a first set of fold lines 111a and 112*a* at opposite ends of a central bottom wall panel 116*a* and has a second set of fold lines 120*a* and 130*a* defining side wall panels 122*a*- and 132*a*. A series of narrow longitudinal slots 125*a*, 126*a*, 135*a* and 136*a* are provided in the double-faced corrugated portion of the board 102*a* in alignment with the associated longitudinal fold lines to define corner slaps 121*a*, 123*a*, 131*a* and 133*a*. These subsidiary flaps are hingedly connected to the side wall panels 122*a* and 132*a* along the outer portions of the transverse fold lines 111*a* and 112*a*.

As herein shown rectangular end wall panels 115*a* and 117*a*, with a width equal to that of side walls panel 122*a* and 132*a*, are hingedly connected to the main central panel 116*a* along the fold lines 111*a* and 112*a*, respectively. These end panels function like panels 115 and 117 of the tray T to close the opposite ends of the tray, and it will be understood that they may be cut along the lines 211 and 212 so as to serve as a single thickness wall.

If desired transverse fold lines 211 and 212 can be provided at the outer edges of the panels 115*a* and 117*a* in connection with auxiliary end wall panels 115*b* and 117*b* of the same size as the end panels 115*a* and 117*a*. This avoids waste of material in the box blank $B^2$ and provides a double-wall construction at both ends of the assembled tray. This double wall is further reinforced by the double-faced corrugated corner flaps 121*a*, 123*a*, 131*a* and 133*a*, each of which has a length equal to approximately half the distance between the fold lines 120*a* and 130*a* so that the reinforceed side edges of each pair of flaps meet at the center of an end wall of the assembled tray. The corner flaps at each end of the tray thus provide additional reinforcement for the two-panel end wall at each end, thereby forming a three-layer end wall on that end of the tray.

It will be understood that the end panels 115*b* and 117*b* may be omitted, and it will also be understood that all or part of the end panels 115*a* and 117*a* may be omitted because the elongated end flaps are sufficient to close the ends of the tray. It is preferable to retain the end-wall panels 115*a* and 117*a*, and, when these panels are present, they can be adequately reinforced by the elongated corner flaps, even when the flaps do not cover the entire end wall.

In the practice of the present invention it is usually preferable to employ longitudinal or transverse slots in the container blank to permit pivotal movement of the associated flaps of the tray or carton, but it will be understood that special fold lines may be employed in some types of container blanks which eliminate the need for slots. This principal is illustrated, for example, in U.S. Pat. No. 2,646,917.

The containers of the present invention are particularly advantageous because they employ a minimum amount of machinery and material and can be manufactured at minimum cost using continuous mass production methods and high machine speeds, such as 400 to 650 feet per minute.

FIG. 1 indicates how the container blanks B′ may be produced by a continuous process, it being understood that various types of equipment may be employed for this purpose. The apparatus is shown herein for purposes of illustration rather than limitation, it being understood that other conventional equipment can also be employed.

As shown in FIG. 1 the continuous facing sheet f and the overlying continuous corrugated web w are continuously fed past the glue station G, the guide assembly 50, and the pressure roll unit 60 to a conventional type of rotary die cutting unit A. The equipment may, for example, be designed for operation at speeds of 500 to 650 feet per minute. The adhesive applying means of the glue station may be of any conventional construction and is designed to apply a suitable adhesive along adhesive areas 141 and 142 at opposite sides of the web, each having a width corresponding to that of the fly portions 107 and 108 of the facing sheet. A line of adhesive would be applied to the outer portion of each corrugation of the core.

The glue station is shown schematically as having a pair of glue rollers 41 and 42 with an axial length corresponding to the width of the areas 141 and 143, suitable means being provided for driving both glue rollers at the same speed. As illustrated the two rolls are connected by a drive shaft 43 and are located in housings 44 which may be suspended above the web in any suitable manner. As shown a drive wheel 45 is mounted on the end of the shaft 43 and is driven by a belt or pulley 46 through suitable over-head drive means (not shown).

It will be understood that the two-ply laminated comprising sheet f adhered to web w need not be in the horizontal position at the time the glue is applied to the tips of the flutes at areas 141 and 143. The glue obviously can be applied when the laminate moves upwardly (see U.S. Pat. No. 3,775,211) or when the laminate is inverted (see U.S. Pat. No. 3,303,814). The method of glue application shown for convenience in FIG. 1 is not necessarily the preferred method.

As herein shown the facing sheet f lies flat as it passes under the glue applicator rollers, and the fly portions of the sheet extending outwardly of the corrugated web w remain flat and parallel to the web until they engage the leading end of the guide assembly 50.

Any suitable means, such as guide rollers or stationary guides, may be employed to effect the desired folding of the fly portions around the side edges of the web. The guide means may, for example, be of the general type shown in FIG. 4 of U.S. Pat. No. 3,655,478. As herein shown the assembly 50 includes a pair of curved guide members 51 and 52 in the form of metal angles of conventional L-shaped cross section. The guide 51 is formed from a standard metal angle which is bent to provide a vertical leading end portion 53 and a horizontal trailing end portion 54 on one flange of the angle. The other flange of the angle is horizontal at the leading end portion and is bent to provide a vertical trailing portion 55.

The guide 52 is of the same size as the guide 51, and is bent in a similar manner but is bent in the opposite direction so that the upper flange of the metal angle has a vertical leading portion 56 and horizontal trailing portion 57. The guide members 51 and 52 are somewhat like the guide channel of said U.S. Pat. No. 3,655,478 and are bent in such a manner that the fly portions 107 and 108 of the facing sheet are gradually lifted from the horizontal position and folded 180 degrees back over the glued portions 141 and 143 at the opposite sides of the web.

After leaving the guide assembly 50, the laminated strip passes between the rollers 61 and 62 of the unit 60. This causes the fly portions 107 and 108 to be pressed tightly into engagement with the glued areas of the corrugated web. If desired heat may be applied at the pressure roller or elsewhere to assist in setting the adhesive, but this is not required.

After passing through the unit 60, the laminated board 102 passes between the upper and lower rolls of a rotary die cutting unit A. As shown the upper shaft 71 of the unit A has a gear drive 72 which meshes with a similar gear 73 carried by the lower shaft 74. The shaft 74 may be driven by any suitable drive means (not shown).

The unit A can be of a conventional type commonly used for slotting and scoring conventional double-wall corrugated material. It may, for example, be similar to a rotary diecutting module made by Bernal Rotary Systems, Inc.

The corrugated board is cut to length in the unit A along line 113 and is cut to provide the transverse slots 125, 126, 135 and 136. At the same time it may be perforated, creased or otherwise deformed to provide the fold lines or score lines 111, 112, 120 and 130. While these various operations can readily be performed continuously in a single rotary die cutter at very high speeds (see U.S. Pat. No. 2,485,020), it will be understood that separate machines may be employed for each operation.

In a modern plant producing large volumes of doubleface corrugated board continuously, it is common practice to employ a number of different high-speed machines, such as rotary slotters, slitter-creasers, printer-slotters, rotary die cutters, rotary sheet cutoff machines, and automatic foldertapers. The same equipment can also be used to process the special corrugated board used in the practice of this invention, but it is preferable to combine several operations in a single rotary die cutter or the like.

The use of a single wide facing sheet f on a single-facer machine and the elimination of the double-facer machine and its associated glue applying equipment results in a substantial savings in equipment costs as well as in a savings in material. The maximum benefits of the invention are obtained when using the simplest equipment to form the container blanks.

It will be understood that, in accordance with the provisions of the patent statutes, variations and modifications of the specific devices shown herein may be made without departing from the spirit of the invention.

Having described my invention, I claim:

1. A slotted box blank comprising a two-piece laminated board having a generally rectangular corrugated core with transverse corrugations extending between the opposite sides of the core and having a single facing sheet with a width substantially greater than that of said core, said facing sheet having main central portion that is secured to and covers one face of the core and a pair of overturned fly portions that are secured to and cover outer side portions only of the opposite face of the core, each of said fly portions having a length several times its width and extending along said opposite sides of the core to provide reinforced side edges, said box blank having a first set of parallel fold lines transverse to said fly portions which divide the blank into a series of wall panels including rectangular front and back wall panels of the same width and a pair of side wall panels of the same width located on opposite sides of said front wall panel, a major portion of the corrugated core of each wall panel being exposed between the outer edges of said fly portions, said box blank having a second set of fold lines on said fly portions which extend lengthwise over said fly portions to define a plurality of double-faced corrugated end flaps, each of which is hingedly connected to one of said wall panels along a fold line of said second set, and a series of slots extending from the fold lines of said second set to the outer edges of the blank to separate said end flaps, said flaps having a width at least about half the width of said side wall panels for closing opposite ends of the assembled box.

2. A rectangular shipping container made from a blank comprising a two-piece laminated board having a generally rectangular corrugated core with transverse corrugations extending between the opposite sides of the core and having a single facing sheet with a width substantially greater than that of said core, said facing sheet having a main central portion that is secured to and covers one face of the core and a pair of overturned fly portions that are secured to and cover outer side portions only of the opposite face of the core, each of said fly portions having a length several times its width and extending along said opposite sides of the core to provide reinforced side edges, said blank having a first set of parallel fold lines transverse to said fly portions which divide the blank into a series of wall panels, each of which is hingedly connected to an adjacent wall panel along a fold line of said first set, a major portion of the corrugated core of each wall panel being exposed between the outer edges of said fly portions, said blank having a second set of fold lines on said fly portions which extend lengthwise over said fly portions to define double-faced corrugated panels, each of which is hingedly connected to one of said wall panels along a fold line of said second set, and having slots in said double-faced corrugated panels extending from the fold lines of said second set to the outer edges of the blank to define double-faced flaps at the four corners of the blank.

3. A shipping container according to claim 2 in which the fold lines of said first set define front and back wall panels and a pair of side wall panels and are located at the four side edges of the container, and in which said double-faced corrugated panels comprise end flaps for closing the opposite ends of the container, a pair of said end flaps being provided at opposite ends of each of the four wall panels.

4. A rectangular fiberboard box made from a slotted box blank comprising a two-piece laminated board having a generally rectangular corrugated core with lateral corrugations extending between the opposite sides of the core and having a single facing sheet with a width substantially greater than that of said core, said facing sheet having a main central portion that is secured to and covers one face of the core and a pair of overturned fly portions that are secured to and cover outer side portions only of the opposite face of the core, each of said fly portions extending along said opposite sides of the core to provide reinforced side edges, said blank having a first set of parallel fold lines transverse to said fly portions which divide the blank into at least four wall panels, each of which is hingedly connected to an adjacent wall panel along a fold line of said first set, a major portion of the corrugated core of each wall panel being exposed between the outer edges of said fly portions, said blank having a second set of fold lines on said fly portions at opposite ends of the box which extend lengthwise of said fly portions to define at least four pairs of double-faced corrugated end flaps, each of said flaps being hingedly connected to one of said wall panels along a fold line of said second set and being separated from an adjacent end flap by a narrow slot transverse to the associated fly portion.

* * * * *